US011447709B2

(12) United States Patent
Filip

(10) Patent No.: US 11,447,709 B2
(45) **Date of Patent: *Sep. 20, 2022**

(54) METHODS FOR CONTROLLING DEPOSITS

(71) Applicant: BP OIL INTERNATIONAL LIMITED, Middlesex (GB)

(72) Inventor: Sorin Vasile Filip, Middlesex (GB)

(73) Assignee: BP OIL INTERNATIONAL LIMITED, Sunbury On Thames (GB)

( * ) Notice: Subject to any disclaimer, the term of this patent is extended or adjusted under 35 U.S.C. 154(b) by 9 days.

This patent is subject to a terminal disclaimer.

(21) Appl. No.: 16/639,535

(22) PCT Filed: Aug. 13, 2018

(86) PCT No.: PCT/EP2018/071877
§ 371 (c)(1),
(2) Date: Feb. 14, 2020

(87) PCT Pub. No.: WO2019/034584
PCT Pub. Date: Feb. 21, 2019

(65) Prior Publication Data

US 2021/0171849 A1 Jun. 10, 2021

(30) Foreign Application Priority Data

Aug. 14, 2017 (GB) ..... 1713019

(51) Int. Cl.
*C10L 1/233* (2006.01)
*C10L 10/00* (2006.01)
*C10L 10/10* (2006.01)

(52) U.S. Cl.
CPC ..... *C10L 1/2335* (2013.01); *C10L 1/233* (2013.01); *C10L 10/00* (2013.01); *C10L 10/10* (2013.01);
(Continued)

(58) Field of Classification Search
CPC ..... C10L 10/00; C10L 10/10; C10L 1/232; C10L 1/233; C10L 1/2335;
(Continued)

(56) References Cited

U.S. PATENT DOCUMENTS 1,833,429 A 11/1931 Boyd
4,304,712 A 12/1981 Lai
(Continued)

FOREIGN PATENT DOCUMENTS

KR 20120102381 A 9/2012
WO 2006/094210 A2 9/2006
(Continued)

OTHER PUBLICATIONS

The International Search Report (ISR) with Written Opinion for PCT/EP2018/071877 dated Oct. 31, 2018, pp. 1-12.
(Continued)

*Primary Examiner* — Latosha Hines
(74) *Attorney, Agent, or Firm* — McDonnell Boehnen Hulbert & Berghoff LLP

(57) ABSTRACT

A method for improving the deposit control performance of a fuel comprises combining an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms and an atom selected from oxygen or nitrogen directly bonded to the other shared carbon atom, the remaining atoms in the 6- or 7-membered heterocyclic ring being carbon with the fuel. The additive may also be used for controlling deposits in a system which comprises the fuel, such as in a spark-ignition internal combustion engine.

20 Claims, 6 Drawing Sheets

(52) U.S. Cl.
CPC ... *C10L 2200/0423* (2013.01); *C10L 2230/22* (2013.01); *C10L 2270/023* (2013.01)

(58) Field of Classification Search
CPC ..... C10L 2200/0423; C10L 2230/22; C10L 2270/023
See application file for complete search history.

(56) References Cited

U.S. PATENT DOCUMENTS

| | | | | |
|---|---|---|---|---|
| 2008/0196300 | A1* | 8/2008 | Lange | C10L 1/18 44/334 |
| 2010/0210492 | A1* | 8/2010 | Lange | C10L 1/143 44/330 |
| 2014/0163224 | A1* | 6/2014 | Lange | C10L 1/18 544/73 |

FOREIGN PATENT DOCUMENTS

| | | | |
|---|---|---|---|
| WO | 2016038128 | A2 | 3/2016 |
| WO | 2017/137513 | A1 | 8/2017 |
| WO | 2017/137514 | A1 | 8/2017 |
| WO | 2017/137516 | A1 | 8/2017 |
| WO | 2017/137518 | A1 | 8/2017 |
| WO | 2017/137519 | A1 | 8/2017 |
| WO | 2017/137521 | A1 | 8/2017 |

OTHER PUBLICATIONS

Search Report under Section 17(5) for GB1713019.6 dated Feb. 15, 2018, pp. 1-5.

Coulson et al. "The Synthesis and Mass Spectra of 3-Hydroxy-2,3,4,5-tetrahydro-1,5-benzoxazepine and Related Compounds" J. Chem. Soc. (C): 1164-1167 (1971).

Davis et al. "Ion Pair-Directed Regiocontrol in Transition-Metal Catalysis: A Meta-Selective C—H Borylation of Aromatic Quaternary Ammonium Salts" J Am. Chem. Soc. 138: 12759-12762 (2016).

* cited by examiner

METHODS FOR CONTROLLING DEPOSITS

This application is a national stage application under 35 U.S.C. § 371 of International Application No. PCT/EP2018/071877, filed Aug. 13, 2018, which claims priority to Great Britain Patent Application No. GB 1713019.6, filed Aug. 14, 2017, the disclosures of which are explicitly incorporated by reference herein.

FIELD OF THE INVENTION

This invention relates to methods for improving the characteristics of a fuel. In particular, the invention relates to additives for use in methods for improving the deposit control (keep-clean or clean-up) performance of a fuel. The additives may be used to control deposits in a system which comprises a fuel, such as in a spark-ignition internal combustion engine. The invention further relates to additives, as well as fuel compositions and additive compositions which comprise the deposit control additives.

BACKGROUND OF THE INVENTION

Internal combustion engines are widely used for power, both domestically and in industry. For instance, internal combustion engines are commonly used to power vehicles, such as passenger cars, in the automotive industry.

Over time, agglomerations of carbonaceous species can build-up and form deposits on the internal surfaces of an engine. These carbonaceous species may be combustion or oxidation products of the fuel and the lubricant that are used in the engine.

The performance of an engine can be adversely affected by deposits on engine surfaces. For instance, deposits in the fuel delivery system of an engine may impact driveability, for example by diminishing power output and acceleration, while deposits on piston or cylinder surfaces may lead to piston ring sticking. Deposition is particularly critical to modern engine technologies, where the trend is continuing towards higher pressure fuel direct injection to improve fuel efficiency.

Deposit control additives, commonly known as detergents, are typically molecules that have a highly polar end group and a nonpolar hydrocarbon tail. The polar group is able to attach to oxygen-containing polar functional groups that are present in deposits to form aggregates via hydrogen bonding or strong ionic interactions. The nonpolar tail enhances solubility of the detergent in fuel. In combination, the polar and nonpolar groups facilitate deposit removal via several mechanisms, e.g. abrasion (due to strong aerodynamic forces exceeding bonding forces), break off (due to high shearing stress) and wash off (due to high speed flow of fuel, and the efficacy of detergents as solubilising agents).

WO 2006/015818 discloses the use of linear polyamines having at least one terminal secondary or tertiary amine function as detergent additives for fuels and lubricants. WO 2012/004300 discloses a method for preparing quaternized nitrogen-containing additives under acid-free conditions. The additive is used as a detergent in diesel engines. US 2012/149617 discloses the use of polytetrahydrobenzoxazines as a detergent additive in diesel fuels. These detergents may be used in addition to other additives, which each carry out a specific function. It would be desirable for an additive to be effective as a detergent additive, whilst also carrying out another function in the fuel.

GB 2 308 849 discloses dihydro benzoxazine derivatives for use as anti-knock agents. However, the derivatives are not disclosed as having any deposit control effect.

There is a need for further method for controlling deposits (both keeping surfaces clean from deposits, and for cleaning deposits from surfaces) in an engine.

SUMMARY OF THE INVENTION

Surprisingly, it has now been found that an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms and an atom selected from oxygen or nitrogen directly bonded to the other shared carbon atom, the remaining atoms in the 6- or 7-membered heterocyclic ring being carbon, provides a substantial improvement in the deposit control performance of a fuel.

Accordingly, the present invention provides a method for improving the deposit control performance of a fuel, said method comprising combining an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms and an atom selected from oxygen or nitrogen directly bonded to the other shared carbon atom, the remaining atoms in the 6- or 7-membered heterocyclic ring being carbon with the fuel.

The present invention further provides a method for controlling deposits in a system in which a fuel is used, said method comprising combining a deposit control additive described herein with the fuel. A method is also provided for at least one of reducing oil degradation, improving drivability, improving fuel economy and improving durability in an engine in which a fuel is used, said method comprising combining a deposit control additive described herein with the fuel.

Also provided is the use of a deposit control additive described herein as a deposit control additive in a fuel, as well as the use of the deposit control additive for controlling deposits in a system in which a fuel is used, and for at least one of: reducing oil degradation, improving drivability, improving fuel economy and improving durability in an engine.

The present invention further provides a fuel composition comprising a deposit control additive described herein in an amount of from 10 ppm to 500 ppm, preferably from 20 ppm to 400 ppm, and more preferably from 50 ppm to 300 ppm, weight additive/weight base fuel.

Also provided is a deposit control additive composition for a fuel, the composition comprising:

a deposit control additive described herein;
a hydrocarbyl-substituted aromatic compound; and
a polyalkylene amine; and a fuel composition comprising:

a deposit control additive described herein;
a hydrocarbyl-substituted aromatic compound; and
a polyalkylene amine.

The present invention further provides a deposit control additive for a fuel, the additive being in the form of a salt comprising a cation having the formula:

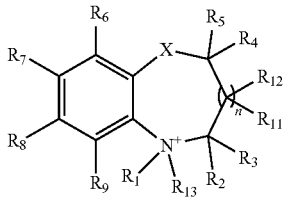

where: $R_1$ is selected from alkyl groups and polymer-containing groups;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups;

n is 0 or 1; and $R_{13}$ is selected from alkyl groups, —$R_{15}$OH and —$R_{15}$COOH, where $R_{15}$ is selected from alkanediyl groups.

BRIEF DESCRIPTION OF THE FIGURES

FIGS. 1*a-f* show images of deposits observed on pistons from a spark-ignition internal combustion engine before and after operation of the engine using a fuel treated with a deposit control additive described herein. Specifically, FIGS. 1*a-c* show images of the pistons before operation of the engine; and FIGS. 1*d-f* show images of the pistons after operation of the engine.

FIGS. 1*a-d* show images of the pistons before operation of the engine; and FIGS. 1*e-h* show images of the pistons after operation of the engine.

FIG. 3*a* shows a graph of the change in octane number of an E0 fuel having a RON prior to additisation of 90; FIG. 3*b* shows a graph of the change in octane number of an E0 fuel having a RON prior to additisation of 95; and FIG. 3*c* shows a graph of the change in octane number of an E10 fuel having a RON prior to additisation of 95.

FIG. 4*a* shows a graph of the change in octane number of an E0 and an E10 fuel against treat rate; FIG. 4*b* shows a graph of the change in octane number of an E0 fuel at a treat rate of 0.67% w/w; and FIG. 4*c* shows a graph of the change in octane number of an E10 fuel at a treat rate of 0.67% w/w.

DETAILED DESCRIPTION OF THE INVENTION

Deposit Control Additive

Figure 1:
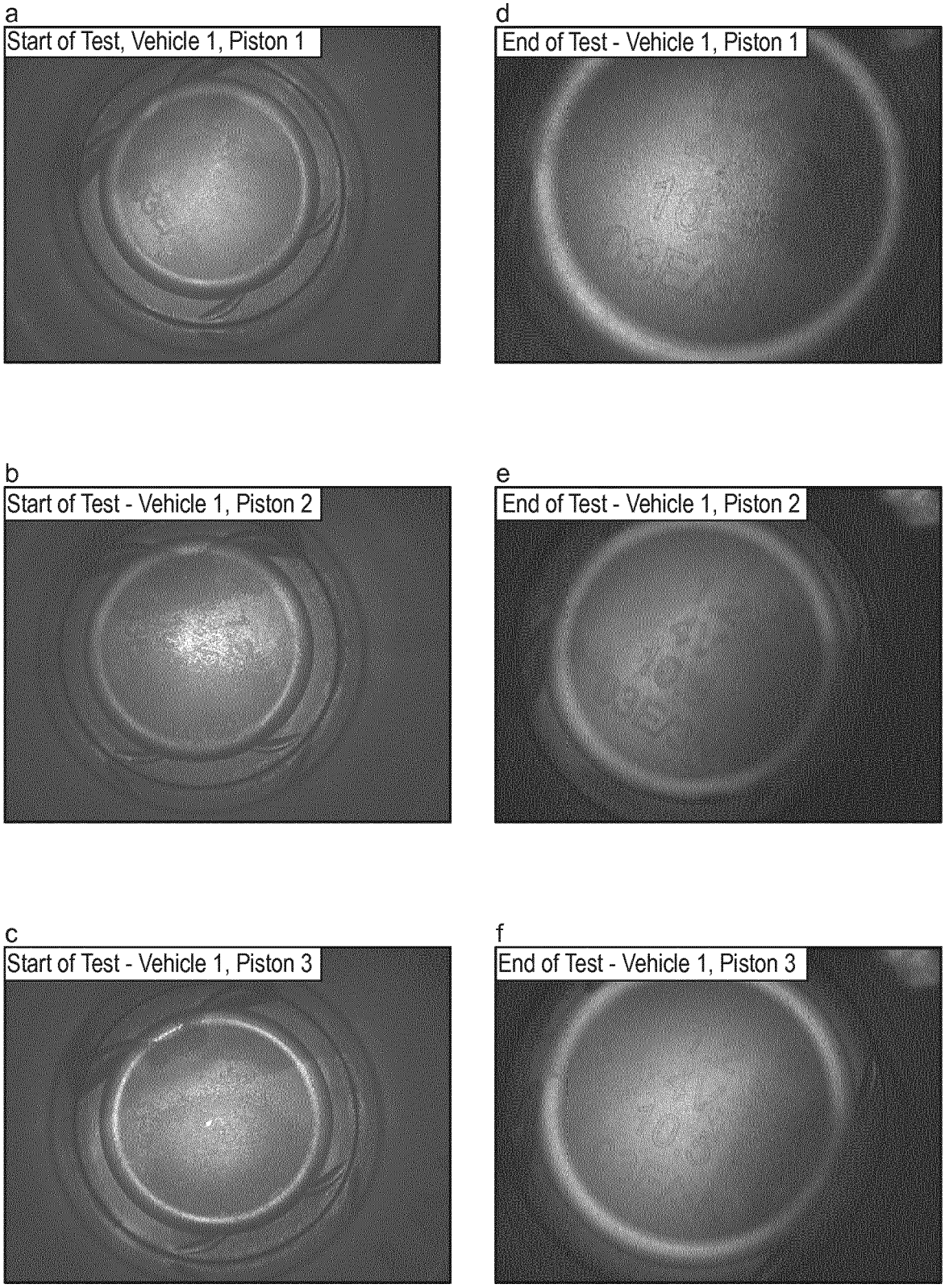

The present invention provides methods and uses in which an additive is used to improve the deposit control performance, such as the keep-clean or clean-up performance, of a fuel.

The additive has a chemical structure comprising a 6-membered aromatic ring sharing two adjacent aromatic carbon atoms with a 6- or 7-membered otherwise saturated heterocyclic ring, the 6- or 7-membered saturated heterocyclic ring comprising a nitrogen atom directly bonded to one of the shared carbon atoms and an atom selected from oxygen or nitrogen directly bonded to the other shared carbon atom, the remaining atoms in the 6- or 7-membered heterocyclic ring being carbon (referred to in short as a deposit control additive described herein). As will be appreciated, the 6- or 7-membered heterocyclic ring sharing two adjacent aromatic carbon atoms with the 6-membered aromatic ring may be considered saturated but for those two shared carbon atoms, and may thus be termed "otherwise saturated."

Alternatively stated, the deposit control additive used in the present invention may be a substituted or unsubstituted 3,4-dihydro-2H-benzo[b][1,4]oxazine (also known as benzomorpholine), or a substituted or unsubstituted 2,3,4,5-tetrahydro-1,5-benzoxazepine. In other words, the additive may be 3,4-dihydro-2H-benzo[b][1,4]oxazine or a derivative thereof, or 2,3,4,5-tetrahydro-1,5-benzoxazepine or a derivative thereof. Accordingly, the additive may comprise one or more substituents and is not particularly limited in relation to the number or identity of such substituents.

Preferred additives have the following formula:

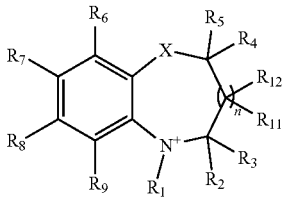

where: $R_1$ is selected from hydrogen, alkyl groups and polymer-containing groups;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1, or are salt forms thereof.

In some embodiments, $R_2$, $R_3$, $R_4$, $R_5$, $R_{11}$ and $R_{12}$ are each independently selected from hydrogen and alkyl groups, and preferably from hydrogen, methyl, ethyl, propyl and butyl groups. More preferably, $R_2$, $R_3$, $R_4$, $R_5$, $R_{11}$ and $R_{12}$ are each independently selected from hydrogen, methyl and ethyl, and even more preferably from hydrogen and methyl.

In some embodiments, $R_6$, $R_7$, $R_8$ and $R_9$ are each independently selected from hydrogen, alkyl and alkoxy groups, and preferably from hydrogen, methyl, ethyl, propyl, butyl, methoxy, ethoxy and propoxy groups. More preferably, $R_6$, $R_7$, $R_8$ and $R_9$ are each independently selected from hydrogen, methyl, ethyl and methoxy, and even more preferably from hydrogen, methyl and methoxy.

Advantageously, at least one of $R_2$, $R_3$, $R_4$, $R_5$, $R_6$, $R_7$, $R_8$, $R_9$, $R_{11}$ and $R_{12}$, and preferably at least one of $R_6$, $R_7$, $R_8$ and $R_9$, is selected from a group other than hydrogen. More preferably, at least one of $R_7$ and $R_8$ is selected from a group other than hydrogen. Alternatively stated, the deposit control additive may be substituted in at least one of the positions represented by $R_2$, $R_3$, $R_4$, $R_5$, $R_6$, $R_7$, $R_8$, $R_9$, $R_{11}$ and $R_{12}$, preferably in at least one of the positions represented by $R_6$, $R_7$, $R_8$ and $R_9$, and more preferably in at least one of the positions represented by $R_7$ and $R_8$. It is believed that the presence of at least one group other than hydrogen may improve the solubility of the deposit control additives in a fuel.

Also advantageously, no more than five, preferably no more than three, and more preferably no more than two, of $R_2$, $R_3$, $R_4$, $R_5$, $R_6$, $R_7$, $R_8$, $R_9$, $R_{11}$ and $R_{12}$ are selected from a group other than hydrogen. Preferably, one or two of $R_2$, $R_3$, $R_4$, $R_5$, $R_6$, $R_7$, $R_8$, $R_9$, $R_{11}$ and $R_{12}$ are selected from a group other than hydrogen. In some embodiments, only one of $R_2$, $R_3$, $R_4$, $R_5$, $R_6$, $R_7$, $R_8$, $R_9$, $R_{11}$ and $R_{12}$ is selected from a group other than hydrogen.

It is also preferred that at least one of $R_2$ and $R_3$ is hydrogen, and more preferred that both of $R_2$ and $R_3$ are hydrogen.

In preferred embodiments, at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ are selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

In further preferred embodiments, at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

Preferably, X is —O— or —$NR_{10}$—, where $R_{10}$ is selected from hydrogen, methyl, ethyl, propyl and butyl groups, and preferably from hydrogen, methyl and ethyl groups. More preferably, $R_{10}$ is hydrogen. In preferred embodiments, X is —O—.

n may be 0 or 1, though it is preferred that n is 0.

$R_1$ is preferably selected from hydrogen, methyl, ethyl, propyl and butyl groups. More preferably, $R_1$ is selected from hydrogen, methyl and ethyl, and even more preferably from hydrogen and methyl.

In preferred embodiments, $R_1$ is hydrogen. Compounds in which $R_1$ is hydrogen are particularly effective at increasing the octane number of a fuel.

However, in some embodiments, $R_1$ may also be a longer-chain group. Thus, $R_1$ may be selected from $C_{2-36}$ alkyl groups.

$R_1$ may also be a polymer-containing group having the structure:

-A-B-C.

In these embodiments, A may be present or absent, and is selected from —O—, —$OR_{16}$— and —$R_{16}$—.

$R_{16}$ is selected from alkanediyl and alkenediyl groups, preferably from $C_{1-10}$ alkanediyl and $C_{1-10}$ alkenediyl groups, more preferably from $C_{1-10}$ alkanediyl groups, and still more preferably from $C_{1-5}$ alkanediyl groups.

B is a polymer, preferably a polyolefin or a polyether, more preferably a polyolefin or polyether in which the monomer units contain from 1-10 carbon atoms and preferably from 1-5 carbon atoms.

Preferably, B is a polymer which contains from 5 to 2000 monomer units, more preferably from 8 to 500 monomer units, and still more preferably from 10 to 20 monomer units.

C is selected from alkyl and alkoxy groups, preferably from $C_{1-20}$ alkyl and $C_{1-20}$ alkoxy groups, more preferably from $C_{1-10}$ alkyl groups, and still more preferably from $C_{1-5}$ alkyl groups.

Deposit control additives that may be used in the present invention include:

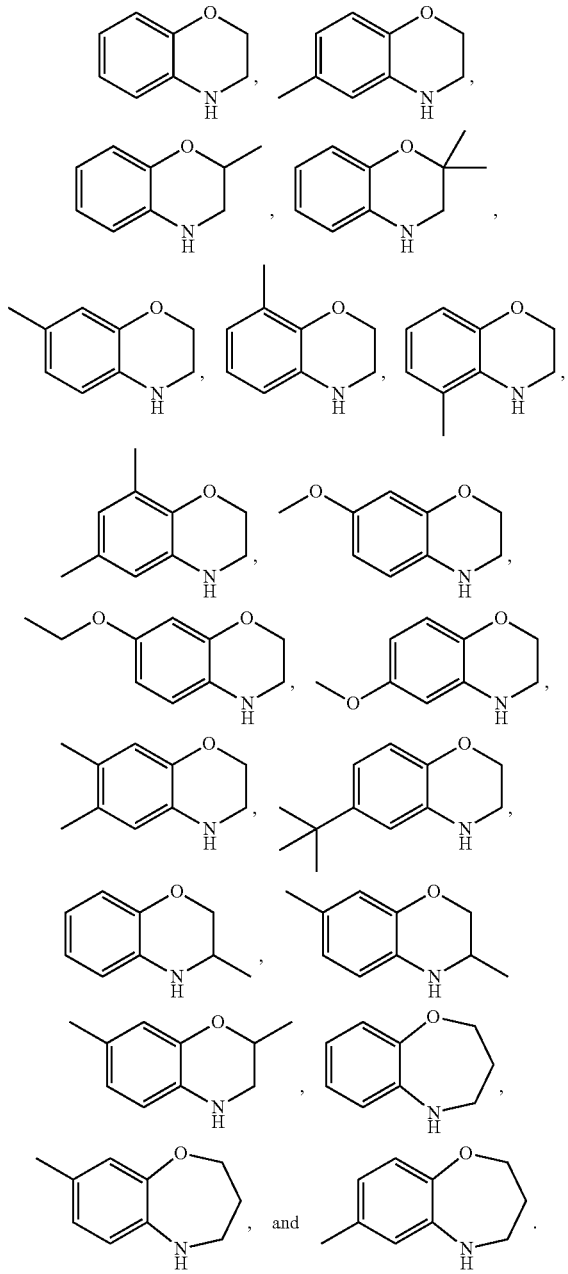

Preferred deposit control additives include:

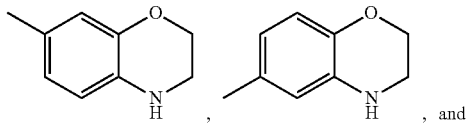

-continued

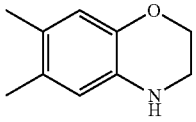

Particularly preferred is:

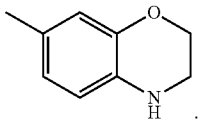

A mixture of additives may be used in the fuel composition. For instance, the fuel composition may comprise a mixture of:

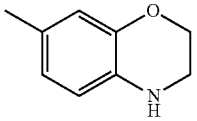

and

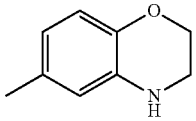

In some embodiments, the deposit control additive is in the form of a salt. It will be appreciated that, since the additives are for use in a fuel, any salt form must be suitable for use in a fuel. In other words, only fuel-compatible salts may be used.

The salt preferably comprises a cation having the formula:

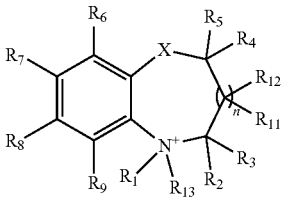

where: $R_1$ is selected from alkyl groups and polymer-containing groups;

$R_2$ to $R_9$, $R_{11}$, $R_{12}$, X and n are as defined above; and $R_{13}$ is selected from alkyl groups, —$R_{15}$OH and —$R_{15}$COOH, where $R_{15}$ is selected from alkanediyl groups.

In preferred embodiments, $R_1$ is an alkyl group, preferably selected from methyl, ethyl, propyl and butyl groups, preferably from methyl and ethyl, and more preferably is methyl.

However, as mentioned above, $R_1$ may also be a longer-chain alkyl group, or a polymer-containing group.

In preferred embodiments, $R_{13}$ is selected from methyl, ethyl, propyl and butyl groups, preferably from methyl and ethyl, and more preferably is methyl.

However, $R_{13}$ may also be selected from —$R_{15}$OH and —$R_{15}$COOH, where $R_{15}$ is selected from alkanediyl groups, preferably $C_{1-10}$ alkanediyl groups, and more preferably from $C_{1-5}$ alkanediyl groups.

Typically, $R_1$ and $R_{13}$ will be the same alkyl group.

The salt preferably comprises an anion selected from halides, sulfonates, sulfates, carbonates, bicarbonate, phosphate, borates, nitrates and nitrites. More preferably, the anion is selected from $Cl^-$, $Br^-$, $NO_3^-$, $R_{14}SO_4^-$, $R_{14}CO_3^{2-}$, $R_{14}CO_2^-$, where each $R_{14}$ is independently selected from alkyl groups, preferably from $C_{1-26}$ alkyl groups.

Where a small anion is used, such as $Cl^-$, $Br^-$ or $NO_3^-$, it may be preferably for at least one of $R_6$, $R_7$, $R_8$ and $R_9$ of the cation to be a longer alkyl group, e.g. a $C_{12-26}$ alkyl group, to improve solubility of the salt.

In embodiments where $R_{13}$ is selected from —$R_{15}$COOH groups, then the carboxylic acid group may exist in an anionic form, i.e. as —$R_{15}$COO, and the salt may be a zwitterion.

It will be appreciated that references to alkyl groups include different isomers of the alkyl group. For instance, references to propyl groups embrace n-propyl and i-propyl groups, and references to butyl embrace n-butyl, isobutyl, sec-butyl and tert-butyl groups.

Fuel Composition

The deposit control additives described herein are used to improve the deposit control performance of a fuel. Preferably, the deposit control additives may be used to improve the deposit control performance of a fuel for an internal combustion engine, e.g. a spark-ignition internal combustion engine. Gasoline fuels (including those containing oxygenates) are typically used in spark-ignition internal combustion engines. Commensurately, the fuel composition according to the present invention may be a gasoline fuel composition.

The deposit control additives described herein may be combined with the fuel to form a fuel composition. The fuel composition may comprise a major amount (i.e. greater than 50% by weight) of liquid fuel ("base fuel") and a minor amount (i.e. less than 50% by weight) of deposit control additive described herein, i.e. an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms and an atom selected from oxygen or nitrogen directly bonded to the other shared carbon atom, the remaining atoms in the 6- or 7-membered heterocyclic ring being carbon.

Examples of suitable liquid fuels include hydrocarbon fuels, oxygenate fuels and combinations thereof.

Hydrocarbon fuels that may be used in an internal combustion engine may be derived from mineral sources and/or from renewable sources such as biomass (e.g. biomass-to-liquid sources) and/or from gas-to-liquid sources and/or from coal-to-liquid sources.

Oxygenate fuels that may be used in an internal combustion engine contain oxygenate fuel components, such as alcohols and ethers. Suitable alcohols include straight and/or branched chain alkyl alcohols having from 1 to 6 carbon atoms, e.g. methanol, ethanol, n-propanol, n-butanol, isobutanol, tert-butanol. Preferred alcohols include methanol and ethanol. Suitable ethers include ethers having 5 or more carbon atoms, e.g. methyl tert-butyl ether and ethyl tert-butyl ether.

In some preferred embodiments, the fuel composition comprises ethanol, e.g. ethanol complying with EN 15376: 2014. The fuel composition may comprise ethanol in an amount of up to 85%, preferably from 1% to 30%, more preferably from 3% to 20%, and even more preferably from 5% to 15%, by volume. For instance, the fuel may contain ethanol in an amount of about 5% by volume (i.e. an E5 fuel), about 10% by volume (i.e. an E10 fuel) or about 15% by volume (i.e. an E15 fuel). A fuel which is free from ethanol is referred to as an E0 fuel.

Ethanol is believed to improve the solubility of the deposit control additives described herein in the fuel. Thus, in some embodiments, for instance where the deposit control additive is unsubstituted (e.g. an additive in which $R_1$, $R_2$, $R_3$, $R_4$, $R_5$, $R_6$, $R_7$, $R_8$ and $R_9$ are hydrogen; X is —O—; and n is 0) it may be preferable to use the additive with a fuel which comprises ethanol.

The fuel composition may meet particular automotive industry standards. For instance, the fuel composition may have a maximum oxygen content of 2.7% by mass.

The fuel composition may have maximum amounts of oxygenates as specified in EN 228, e.g. methanol: 3.0% by volume, ethanol: 5.0% by volume, iso-propanol: 10.0% by volume, iso-butyl alcohol: 10.0% by volume, tert-butanol: 7.0% by volume, ethers (e.g. having 5 or more carbon atoms): 10% by volume and other oxygenates (subject to suitable final boiling point): 10.0% by volume.

The fuel composition may have a sulfur content of up to 50.0 ppm by weight, e.g. up to 10.0 ppm by weight.

Examples of suitable fuel compositions include leaded and unleaded fuel compositions. Preferred fuel compositions are unleaded fuel compositions.

In embodiments, the fuel composition meets the requirements of EN 228, e.g. as set out in BS EN 228:2012. In other embodiments, the fuel composition meets the requirements of ASTM D 4814, e.g. as set out in ASTM D 4814-15a. It will be appreciated that the fuel compositions may meet both requirements, and/or other fuel standards.

The fuel composition for an internal combustion engine may exhibit one or more (such as all) of the following, e.g., as defined according to BS EN 228:2012: a minimum research octane number of 95.0, a minimum motor octane number of 85.0 a maximum lead content of 5.0 mg/l, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

As explained in greater detail below, the deposit control additives described herein may advantageously be used as a multi-purpose fuel additive since they also act as octane improvers.

The deposit control additives described herein may be combined with the fuel in an amount of up to 20%, preferably from 0.1% to 10%, and more preferably from 0.2% to 5% weight additive/weight base fuel. Even more preferably, the fuel composition contains the deposit control additive in an amount of from 0.25% to 2%, and even more preferably still from 0.3% to 1% weight additive/weight base fuel. These amounts are particularly suitable when the deposit control additive is used as a multi-purpose fuel additive.

Alternatively, the deposit control additives described herein may be combined with the fuel in an amount of from 10 ppm to 500 ppm, preferably from 20 ppm to 400 ppm, and more preferably from 50 ppm to 300 ppm, weight additive/weight base fuel. These amounts are particularly suitable when the additive is used primarily as a deposit control additive, though octane number improvements may also be observed at these levels.

It will be appreciated that, when more than one deposit control additive described herein is used, these values refer to the total amount of deposit control additive described herein in the fuel.

The deposit control additives described herein may be used as part of a fuel additive composition or as part of a fuel composition that comprises at least one other further fuel additive.

In preferred embodiments, the deposit control additives described herein are used in combination with further deposit control additives (for clarity, referred to herein as detergents). These detergents do not have a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms and an atom selected from oxygen or nitrogen directly bonded to the other shared carbon atom, the remaining atoms in the 6- or 7-membered heterocyclic ring being carbon.

Examples of suitable detergents include polyalkylene amines such as polyisobutylene amines, polyether amines, hydrocarbyl-substituted aromatic compounds such as Mannich Base detergents e.g. polyisobutylene Mannichs, quaternary ammonium salts and betaines. Particularly preferred polyisobutylene amines and hydrocarbyl-substituted aromatic compounds are those described in WO 2015/028391.

In preferred embodiments, the deposit control additives described herein are used in fuel additive compositions and in fuel compositions in combination with a polyalkylene amine, such as polyisobutylene amine. More preferably, the deposit control additives are used in combination with a polyalkylene amine and a hydrocarbyl-substituted aromatic compound, e.g. in combination with a polyisobutylene amine and a Mannich Base detergent.

Examples of other additives that may be present in the fuel or additive compositions include friction modifiers/anti-wear additives, corrosion inhibitors, combustion modifiers, anti-oxidants, valve seat recession additives, dehazers/demulsifiers, dyes, markers, odorants, anti-static agents, anti-microbial agents, and lubricity improvers.

Examples of suitable friction modifiers and anti-wear additives include those that are ash-producing additives or ashless additives. Examples of friction modifiers and anti-wear additives include esters (e.g. glycerol mono-oleate) and fatty acids (e.g. oleic acid and stearic acid).

Examples of suitable corrosion inhibitors include ammonium salts of organic carboxylic acids, amines and heterocyclic aromatics, e.g. alkylamines, imidazolines and tolyltriazoles.

Examples of suitable anti-oxidants include phenolic anti-oxidants (e.g. 2,4-di-tert-butylphenol and 3,5-di-tert-butyl-4-hydroxyphenylpropionic acid) and aminic anti-oxidants (e.g. para-phenylenediamine, dicyclohexylamine and derivatives thereof).

Examples of suitable valve seat recession additives include inorganic salts of potassium or phosphorus.

Examples of suitable octane improvers include non-metallic octane improvers include N-methyl aniline and nitrogen-based ashless octane improvers. Metal-containing octane improvers, including methylcyclopentadienyl manganese tricarbonyl, ferrocene and tetra-ethyl lead, may also be used. However, in preferred embodiments, the fuel composition is free of all added metallic octane improvers including methyl cyclopentadienyl manganese tricarbonyl and other metallic octane improvers including e.g. ferrocene and tetraethyl lead.

Examples of suitable dehazers/demulsifiers include phenolic resins, esters, polyamines, sulfonates or alcohols which are grafted onto polyethylene or polypropylene glycols.

Examples of suitable markers and dyes include azo or anthraquinone derivatives.

Examples of suitable anti-static agents include fuel soluble chromium metals, polymeric sulfur and nitrogen compounds, quaternary ammonium salts or complex organic alcohols. However, the fuel composition is preferably substantially free from all polymeric sulfur and all metallic additives, including chromium based compounds.

In some embodiments, the fuel composition comprises solvent, e.g. which has been used to ensure that the additives are in a form in which they can be stored or combined with the liquid fuel. Examples of suitable solvents include polyethers and aromatic and/or aliphatic hydrocarbons, e.g. heavy naphtha e.g. Solvesso (Trade mark), xylenes and kerosene.

Representative typical and more typical independent amounts of additives (if present) and solvent in the fuel composition are given in the table below. For the additives, the concentrations are expressed by weight (of the base fuel) of active additive compounds, i.e. independent of any solvent or diluent. Where more than one additive of each type is present in the fuel composition, the total amount of each type of additive is expressed in the table below.

| | Fuel Composition | |
|---|---|---|
| | Typical amount (ppm, by weight) | More typical amount (ppm, by weight) |
| Deposit control additives described herein | 1000 to 100000 | 2000 to 50000 |
| Detergents | 10 to 2000 | 50 to 300 |
| Friction modifiers and anti-wear additives | 10 to 500 | 25 to 150 |
| Corrosion inhibitors | 0.1 to 100 | 0.5 to 40 |
| Anti-oxidants | 1 to 100 | 10 to 50 |
| Octane-improvers | 0 to 20000 | 50 to 10000 |
| Dehazers and demulsifiers | 0.05 to 30 | 0.1 to 10 |
| Anti-static agents | 0.1 to 5 | 0.5 to 2 |
| Other additive components | 0 to 500 | 0 to 200 |
| Solvent | 10 to 3000 | 50 to 1000 |

In some embodiments, the fuel composition comprises or consists of additives and solvents in the typical or more typical amounts recited in the table above.

Fuel compositions may be produced by a process which comprises combining, in one or more steps, a fuel for an internal combustion engine with a deposit control additive described herein. In embodiments in which the fuel composition comprises one or more further fuel additives, the further fuel additives may also be combined, in one or more steps, with the fuel.

In some embodiments, the deposit control additive may be combined with the fuel in the form of a refinery additive composition or as a marketing additive composition. Thus, the deposit control additive may be combined with one or more other components (e.g. additives and/or solvents) of the fuel composition as a marketing additive, e.g. at a terminal or distribution point. The deposit control additive may also be added on its own at a terminal or distribution point. The deposit control additive may also be combined with one or more other components (e.g. additives and/or solvents) of the fuel composition for sale in a bottle, e.g. for addition to fuel at a later time.

The deposit control additive and any other additives of the fuel composition may be incorporated into the fuel composition as one or more additive concentrates and/or additive part packs, optionally comprising solvent or diluent.

Uses and Methods

The deposit control additives disclosed herein may be used in a fuel for a spark-ignition internal combustion engine.

Examples of spark-ignition internal combustion engines include direct injection spark-ignition engines and port fuel injection spark-ignition engines. The spark-ignition internal combustion engine may be used in automotive applications, e.g. in a vehicle such as a passenger car.

Examples of suitable direct injection spark-ignition internal combustion engines include boosted direct injection spark-ignition internal combustion engines, e.g. turbocharged boosted direct injection engines and supercharged boosted direct injection engines. Suitable engines include 2.0 L boosted direct injection spark-ignition internal combustion engines. Suitable direct injection engines include those that have side mounted direct injectors and/or centrally mounted direct injectors.

Examples of suitable port fuel injection spark-ignition internal combustion engines include any suitable port fuel injection spark-ignition internal combustion engine including e.g. a BMW 318i engine, a Ford 2.3 L Ranger engine and an MB M111 engine.

The deposit control additives disclosed herein are used to improve the deposit control (keep-clean or clean-up) performance of a fuel. The keep-clean performance of a fuel is understood in the art to denote the tendency of a fuel to prevent the formation of deposits on combustion in an engine. The clean-up performance of a fuel is understood in the art to denote the tendency of the fuel to remove deposits on combustion in an engine.

The deposit control additives improve at least one of the keep-clean and clean-up performance of a fuel. However, in preferred embodiments, the deposit control additives improve both the keep-clean and clean-up performance of a fuel.

The deposit control performance of the additives disclosed herein may be tested according to ASTM D6201-04 (2014). The weight of the deposits that are present on the intake valves is measured in accordance with this method, and is indicative of the deposit control performance of the additives.

Since ASTM D6201-04 (2014) is a keep-clean test, then a slightly modified version of the test may be used to assess the clean-up performance of the additives. According to the modified method, the engine is operated with the unadditised test fuel for a 'dirty-up' period of 100 hours according to the test cycle in ASTM D6201-04 (see section 4.4). The engine may then be operated with the additised fuel for a clean-up test period of 100 hours following the same test cycle. The intake valves are weighed before and after the dirty-up period to determine the weight of deposits that have formed, and again after the clean-up test period. The % deposits removed may then be calculated.

The deposit control additives described herein may be used to control deposits a system in which the fuel is used.

The system may be e.g. a fuel refinery, a fuel storage tank or a fuel transportation tanker. However, in preferred embodiments, the system comprises an engine, preferably an internal combustion engine and more preferably a spark-ignition internal combustion engine. Thus, the system may be a fuel system in a motorised tool, e.g. a lawn-mower, a power generator or a vehicle, such as an automobile (e.g. a passenger car), a motorcycle or a water-borne vessel (e.g. a ship or a boat). Preferably the fuel system comprises an internal combustion engine, and more preferably a spark-ignition internal combustion engine.

In preferred embodiments, the deposit control additives are used to control deposits on an engine surface, e.g. a surface that forms part of an engine component selected from pistons, injectors, inlet valves, turbochargers and combustion chambers.

Since the additives control deposits, they may also be used to reduce oil degradation, improve drivability, improve fuel economy and improve durability in an engine in which a fuel is used.

The methods described herein may comprise the steps of introducing the deposit control additive into an engine, preferably an internal combustion engine, and/or operating the engine.

The deposit control additive is preferably introduced into a system such as an engine with the fuel e.g. as part of a fuel composition (such as a fuel composition described above). For instance, in embodiments in which the system is a fuel system in a vehicle, the method may comprise combining (e.g. by adding, blending or mixing) the deposit control additive with the fuel in a fuel refinery, at a fuel terminal, or at a fuel pump to form a fuel composition, and introducing the fuel composition into the fuel system of the vehicle, e.g. into the fuel tank.

The deposit control additive may also be combined with the fuel within a vehicle in which the fuel is used, either by addition of the additive to the fuel stream or by addition of the additive directly into the combustion chamber. In some embodiments, the deposit control additive may be transferred to the fuel from a lubricant into which the additive has been combined.

It will also be appreciated that the deposit control additive may be added to the fuel in the form of a precursor compound which, under the combustion conditions encountered in an engine, breaks down to form a deposit control additive as defined herein.

The deposit control additives disclosed herein may also be used to increase the octane number of a fuel for a spark-ignition internal combustion engine. Thus, the deposit control additives may be used as a multi-purpose fuel additive.

In some embodiments, the deposit control additives increase the research octane number (RON) or the motor octane number (MON) of the fuel. In preferred embodiments, the deposit control additives increase the RON of the fuel, and more preferably the RON and MON of the fuel. The RON and MON of the fuel may be tested according to ASTM D2699-15a and ASTM D2700-13, respectively.

Since the deposit control additives described herein increase the octane number of a fuel for a spark-ignition internal combustion engine, they may also be used to address abnormal combustion that may arise as a result of a lower than desirable octane number. Thus, the deposit control additives may be used for improving the auto-ignition characteristics of a fuel, e.g. by reducing the propensity of a fuel for at least one of auto-ignition, pre-ignition, knock, mega-knock and super-knock, when used in a spark-ignition internal combustion engine.

The invention will now be described with reference to the following non-limiting examples.

EXAMPLES

Example 1

Preparation of Deposit Control Additives

The following deposit control additives were prepared using standard methods:

OX1

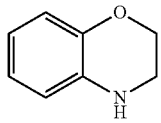

OX2

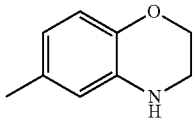

OX3

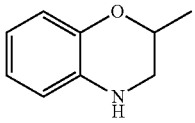

OX4

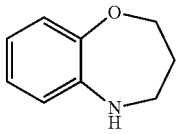

OX5

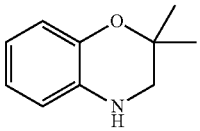

OX6

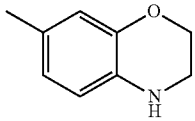

OX7

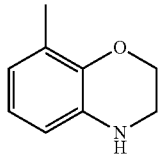

OX8

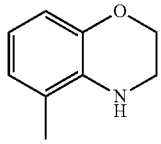

OX9

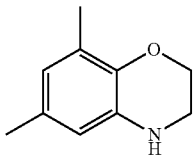

OX10

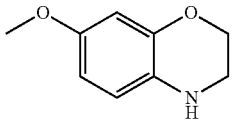

OX11

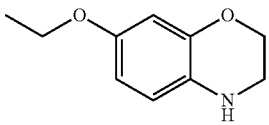

-continued

OX12

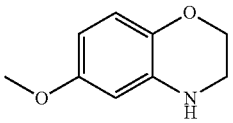

OX13

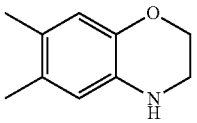

OX14

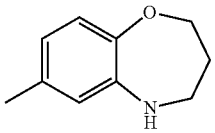

OX15

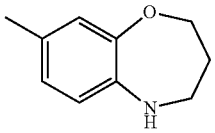

OX16

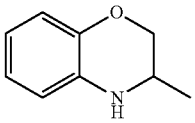

OX17

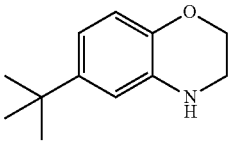

OX18

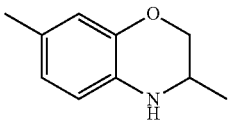

OX19

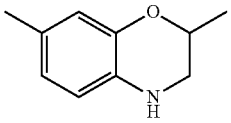

Example 2

Deposit Control Performance of Fuels Containing Deposit Control Additives

The effect of a deposit control additive from Example 1 (OX6) on the deposit control performance of a fuel for a spark-ignition internal combustion engine was tested.

Three vehicles were purchased having approximately 40,000 miles on board. The deposit control additive OX6 was added to an E10 gasoline fuel that was available on the market at a treat rate of 0.5% volume additive/volume fuel. The deposit control performance of the blend of gasoline fuel and deposit control additive was tested by running the vehicles with the blended fuel for 2005 miles. The vehicle combustion chambers were optically inspected using a borescope before and after the test.

After all of the tests, the piston top surfaces appeared cleaner, with a significant amount of the pre-test deposits removed by the deposit control additive. No new deposits were observed. This was consistent across all four of the engine pistons in each of the vehicles tested.

Figure 2:
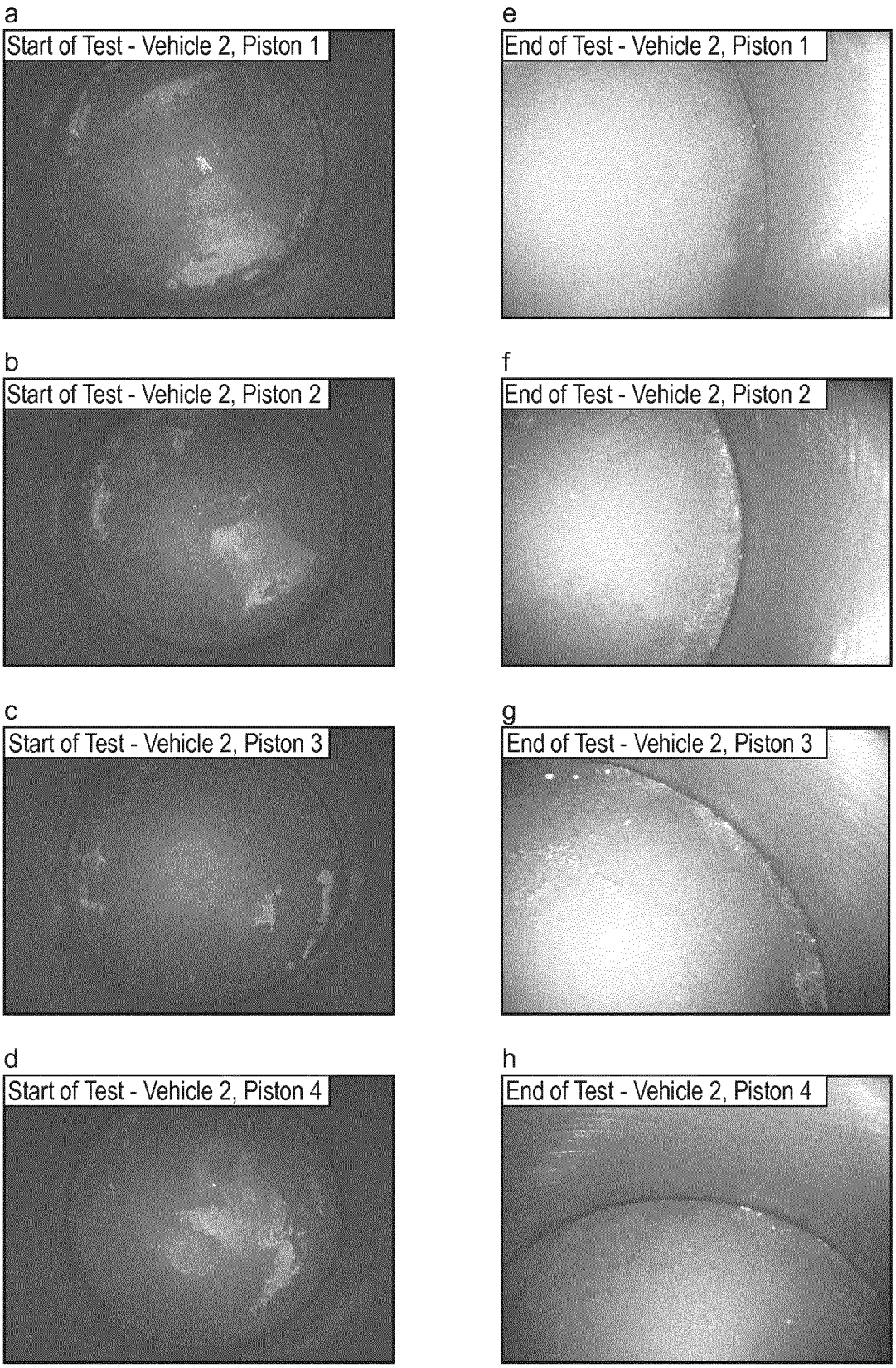
FIGS. 2*a-h* show images of deposits observed on a piston from another spark-ignition internal combustion engine before and after operation of the engine using a fuel treated with a deposit control additive described herein. Specifically.

FIG. 1 shows images of the piston top surfaces from one of the engines before and after testing. A comparison of the images obtained before testing (FIGS. 1*a-c*) and after testing (FIGS. 1*d-f*) shows that many deposits were removed during the testing. On some pistons, writing became visible that was previously obscured by deposits FIG. 2 shows images of the piston top surfaces from another engine. These images also show significantly more deposits on the pistons before testing (see FIGS. 2*a-d*) than after testing (see FIGS. e-h).

Example 3

Octane Number of Fuels Containing Deposit Control Additives

The effect of deposit control additives from Example 1 (OX1, OX2, OX3, OX5, OX6, OX8, OX9, OX12, OX13, OX17 and OX19) on the octane number of two different base fuels for a spark-ignition internal combustion engine was measured.

The additives were added to the fuels at a relatively low treat rate of 0.67% weight additive/weight base fuel, equivalent to a treat rate of 5 g additive/litre of fuel. The first fuel was an E0 gasoline base fuel. The second fuel was an E10 gasoline base fuel. The RON and MON of the base fuels, as well as the blends of base fuel and deposit control additive, were determined according to ASTM D2699 and ASTM D2700, respectively.

The following table shows the RON and MON of the fuel and the blends of fuel and deposit control additive, as well as the change in the RON and MON that was brought about by using the deposit control additives:

| | E0 base fuel | | | | E10 base fuel | | | |
|---|---|---|---|---|---|---|---|---|
| Additive | RON | MON | ΔRON | ΔMON | RON | MON | ΔRON | ΔMON |
| — | 95.4 | 86.0 | n/a | n/a | 95.4 | 85.2 | n/a | n/a |
| OX1 | — | — | — | — | 97.3 | 86.3 | 1.9 | 1.1 |
| OX2 | 97.7 | 87.7 | 2.3 | 1.7 | 97.8 | 86.5 | 2.4 | 1.3 |
| OX3 | 97.0 | 86.7 | 1.6 | 0.7 | 97.1 | 85.5 | 1.7 | 0.3 |
| OX5 | 97.0 | 86.5 | 1.6 | 0.5 | 97.1 | 85.5 | 1.7 | 0.3 |
| OX6 | 98.0 | 87.7 | 2.6 | 1.7 | 98.0 | 86.8 | 2.6 | 1.6 |

-continued

| Additive | E0 base fuel RON | E0 base fuel MON | E0 base fuel ΔRON | E0 base fuel ΔMON | E10 base fuel RON | E10 base fuel MON | E10 base fuel ΔRON | E10 base fuel ΔMON |
|---|---|---|---|---|---|---|---|---|
| OX8 | 96.9 | 86.1 | 1.5 | 0.1 | 96.9 | 85.7 | 1.5 | 0.5 |
| OX9 | 97.6 | 86.9 | 2.2 | 0.9 | 97.6 | 86.5 | 2.2 | 1.3 |
| OX12 | 97.4 | 86.3 | 2.0 | 0.3 | 97.3 | 86.1 | 1.9 | 0.9 |
| OX13 | 97.9 | 86.5 | 2.5 | 0.5 | 97.7 | 86.1 | 2.3 | 0.9 |
| OX17 | 97.5 | 86.4 | 2.1 | 0.4 | 97.4 | 86.4 | 2.0 | 1.2 |
| OX19 | 97.4 | 86.1 | 2.0 | 0.1 | 97.6 | 85.9 | 2.2 | 0.7 |

It can be seen that the deposit control additives may be used to increase the RON of an ethanol-free and an ethanol-containing fuel for a spark-ignition internal combustion engine.

Further additives from Example 1 (OX4, OX7, OX10, OX11, OX14, OX15, OX16 and OX18) were tested in the E0 gasoline base fuel and the E10 gasoline base fuel. Each of the additives increased the RON of both fuels, aside from OX7 where there was insufficient additive to carry out analysis with the ethanol-containing fuel.

Example 4

Variation of Octane Number with Deposit Control Additive Treat Rate

The effect of a deposit control additive from Example 1 (OX6) on the octane number of three different base fuels for a spark-ignition internal combustion engine was measured over a range of treat rates (% weight additive/weight base fuel).

The first and second fuels were E0 gasoline base fuels. The third fuel was an E10 gasoline base fuel. As before, the RON and MON of the base fuels, as well as the blends of base fuel and deposit control additive, were determined according to ASTM D2699 and ASTM D2700, respectively.

The following table shows the RON and MON of the fuels and the blends of fuel and deposit control additive, as well as the change in the RON and MON that was brought about by using the deposit control additives:

| | Additive treat rate (% w/w) | Octane number RON | MON | ΔRON | ΔMON |
|---|---|---|---|---|---|
| E0 90 RON | 0.00 | 89.9 | 82.8 | 0.0 | 0.0 |
| | 0.20 | 91.5 | 83.5 | 1.6 | 0.7 |
| | 0.30 | 92.0 | 83.6 | 2.1 | 0.8 |
| | 0.40 | 92.5 | 83.8 | 2.6 | 1.0 |
| | 0.50 | 92.9 | 83.8 | 3.0 | 1.0 |
| | 0.67 | 93.6 | 84.2 | 3.7 | 1.4 |
| | 1.01 | 94.7 | 85.0 | 4.8 | 2.2 |
| | 1.34 | 95.9 | 85.4 | 6.0 | 2.6 |
| | 10.00 | 104.5 | 87.9 | 14.6 | 5.1 |
| E0 95 RON | 0.00 | 95.2 | 85.6 | 0.0 | 0.0 |
| | 0.10 | 95.9 | 85.8 | 0.7 | 0.2 |
| | 0.20 | 96.4 | 86.3 | 1.2 | 0.7 |
| | 0.30 | 96.6 | 86.8 | 1.4 | 1.2 |
| | 0.40 | 97.1 | 86.6 | 1.9 | 1.0 |
| | 0.50 | 97.3 | 87.0 | 2.1 | 1.4 |
| | 0.60 | 97.5 | 86.8 | 2.3 | 1.2 |
| | 0.70 | 97.8 | 86.8 | 2.6 | 1.2 |
| | 0.80 | 98.0 | 87.3 | 2.8 | 1.7 |
| | 0.90 | 98.5 | 86.8 | 3.3 | 1.2 |
| | 1.00 | 98.7 | 86.9 | 3.5 | 1.3 |
| | 10.00 | 105.7 | 88.7 | 10.5 | 3.1 |
| E10 95 RON | 0.00 | 95.4 | 85.1 | 0.0 | 0.0 |
| | 0.10 | 95.9 | 85.2 | 0.5 | 0.1 |

-continued

| Additive treat rate (% w/w) | Octane number RON | MON | ΔRON | ΔMON |
|---|---|---|---|---|
| 0.20 | 96.3 | 86.3 | 0.9 | 1.2 |
| 0.30 | 96.8 | 86.3 | 1.4 | 1.2 |
| 0.40 | 96.9 | 85.8 | 1.5 | 0.7 |
| 0.50 | 97.3 | 85.9 | 1.9 | 0.8 |
| 0.60 | 97.4 | 85.9 | 2.0 | 0.8 |
| 0.70 | 97.9 | 86.0 | 2.5 | 0.9 |
| 0.80 | 98.2 | 86.8 | 2.8 | 1.7 |
| 0.90 | 98.7 | 86.3 | 3.3 | 1.2 |
| 1.00 | 98.8 | 86.5 | 3.4 | 1.4 |
| 10.00 | 105.1 | 87.8 | 9.7 | 2.7 |

Figure 3A:
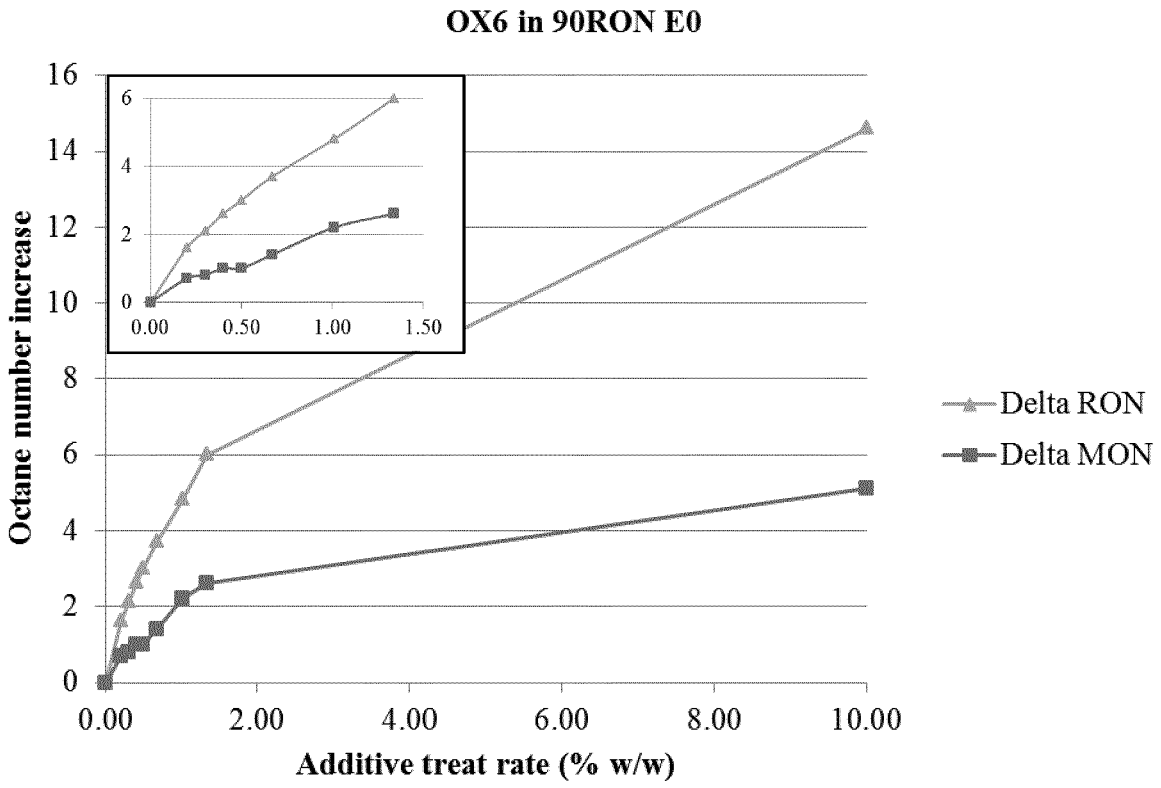
FIGS. 3*a-c* show graphs of the change in octane number (both RON and MON) of fuels when treated with varying amounts of a deposit control additive described herein. Specifically.
Figure 3B:
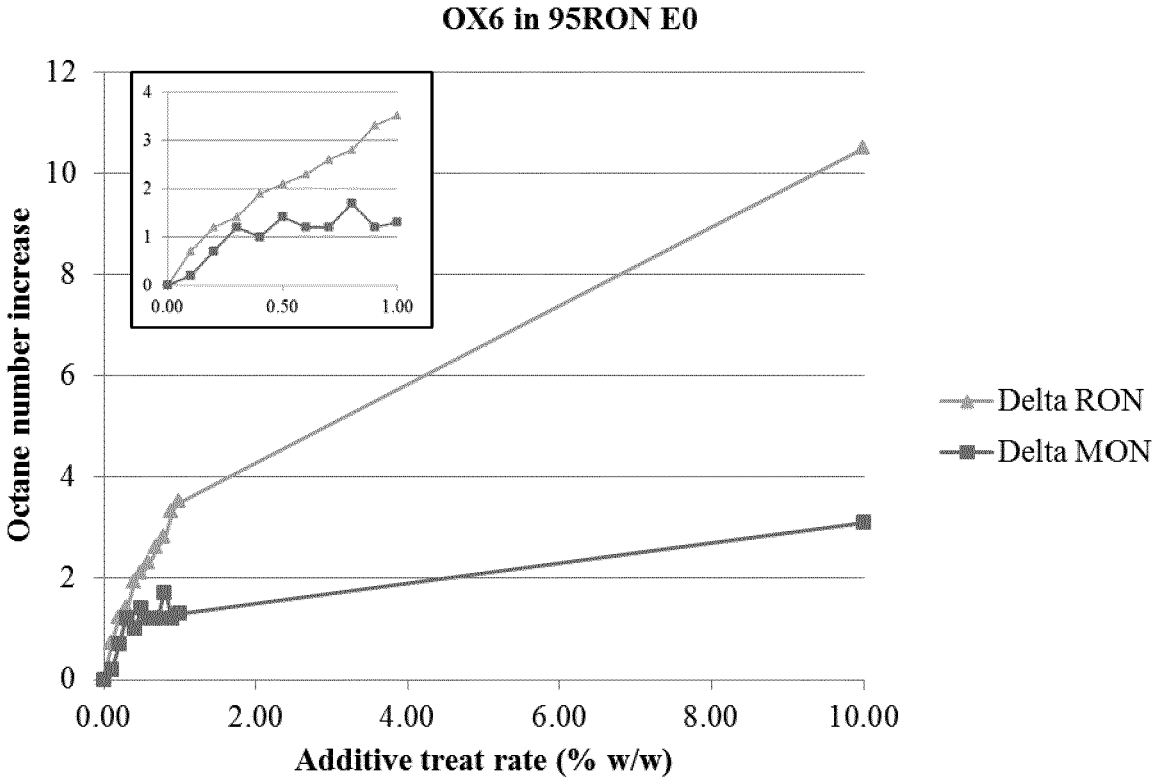
Figure 3C:
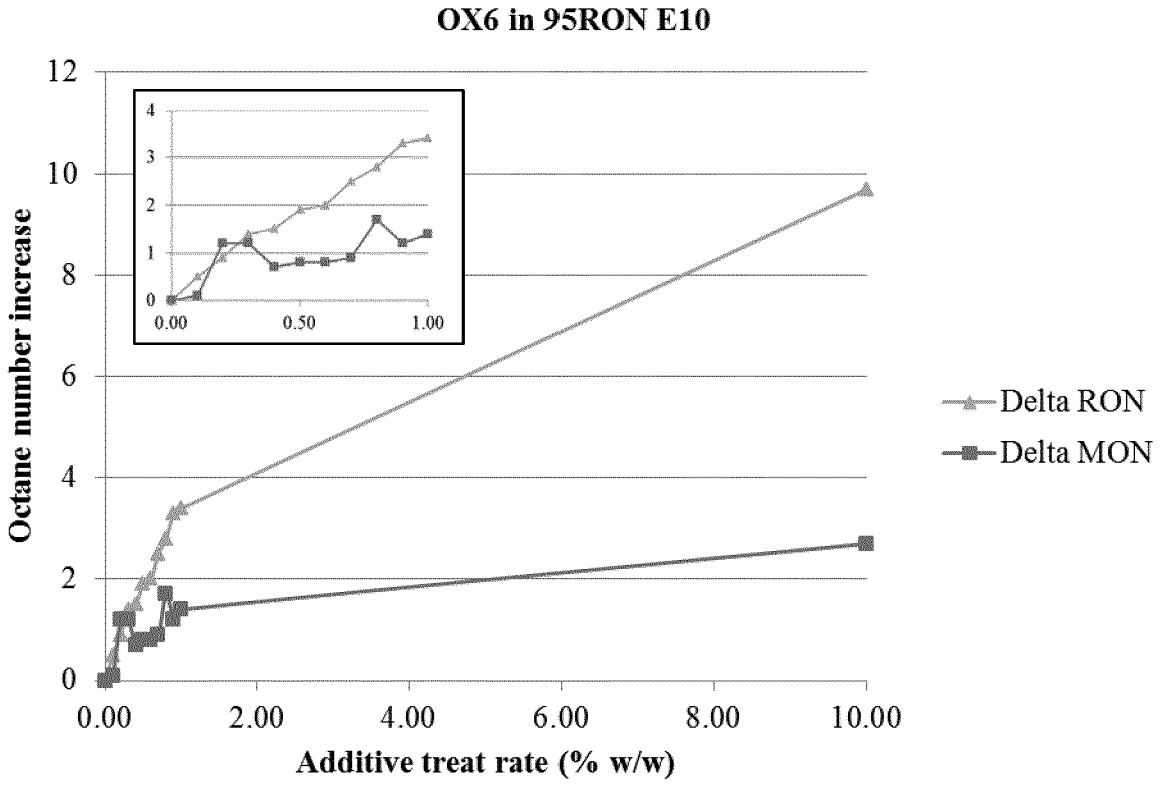

Graphs of the effect of the deposit control additive on the RON and MON of the three fuels are shown in FIGS. 3*a-c*. It can be seen that the deposit control additive had a significant effect on the octane numbers of each of the fuels, even at very low treat rates.

Example 4

Comparison of Deposit Control Additive with N-Methyl Aniline

The effect of deposit control additives from Example 1 (OX2 and OX6) was compared with the effect of N-methyl aniline on the octane number of two different base fuels for a spark-ignition internal combustion engine over a range of treat rates (% weight additive/weight base fuel).

The first fuel was an E0 gasoline base fuel. The second fuel was an E10 gasoline base fuel. As before, the RON and MON of the base fuels, as well as the blends of base fuel and deposit control additive, were determined according to ASTM D2699 and ASTM D2700, respectively.

Figure 4A:
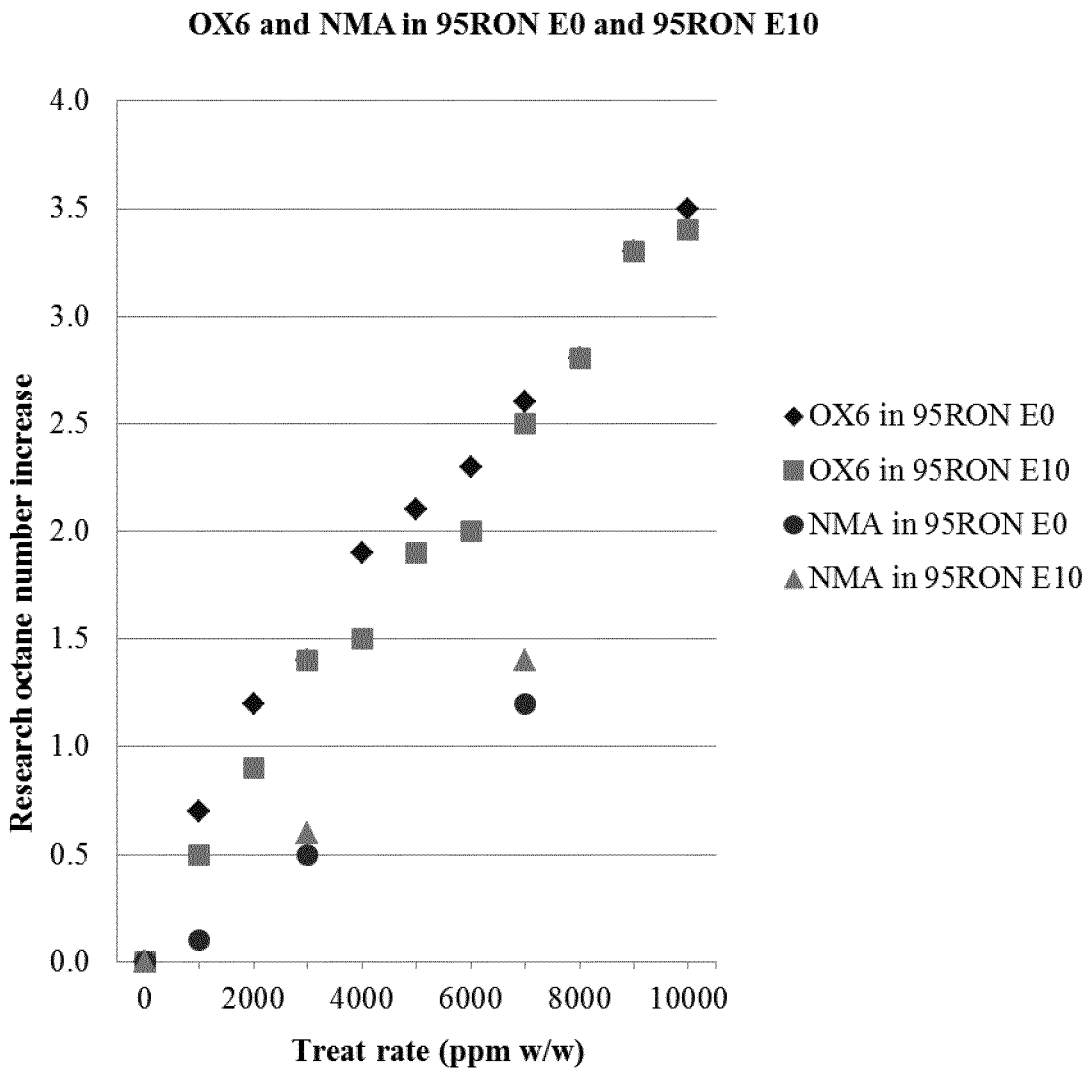
FIGS. 4*a-c* show graphs comparing the change in octane number (both RON and MON) of fuels when treated with deposit control additives described herein and N-methyl aniline. Specifically.

A graph of the change in octane number of the E0 and E10 fuels against treat rate of N-methyl aniline and a deposit control additive (OX6) is shown in FIG. 4*a*. The treat rates are typical of those used in a fuel. It can be seen from the graph that the performance of the deposit control additives described herein is significantly better than that of N-methyl aniline across the treat rates.

Figure 4B:
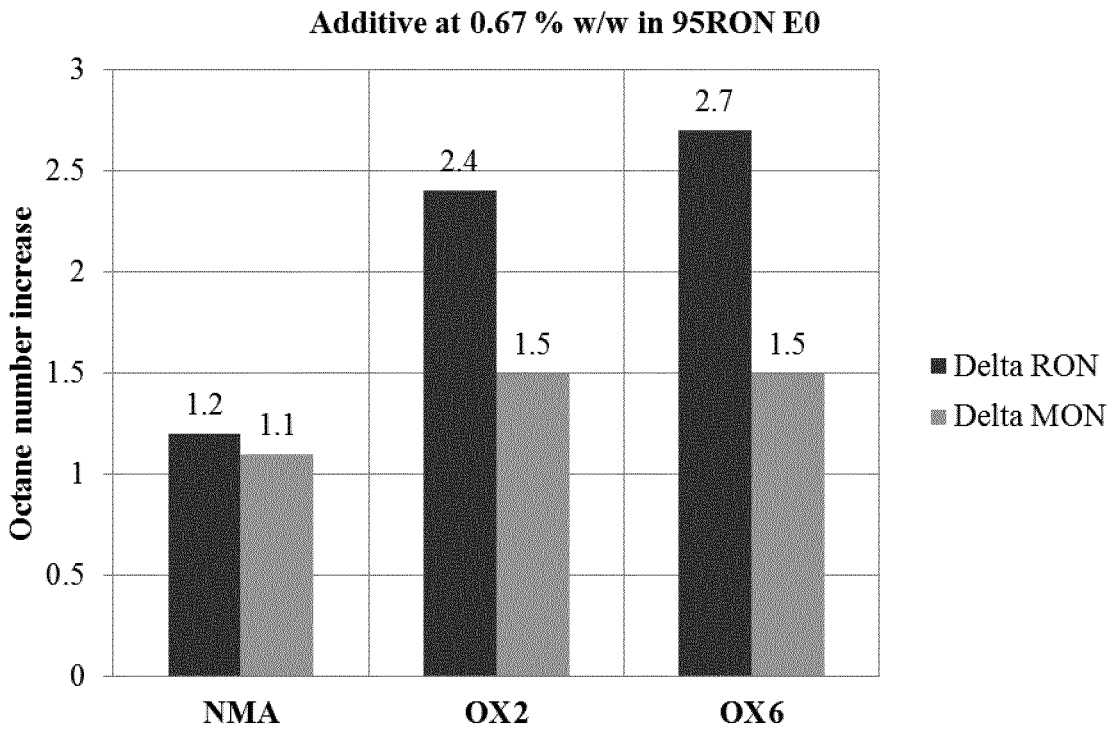
Figure 4C:
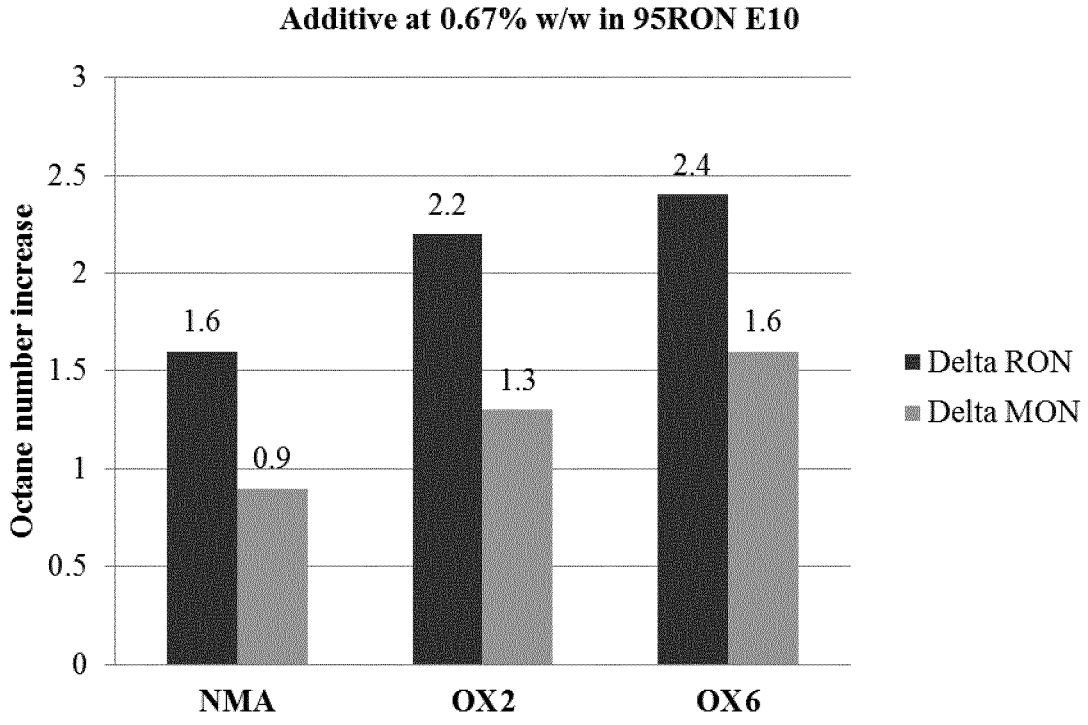

A comparison of the effect of two deposit control additives (OX2 and OX6) and N-methyl aniline on the octane number of the E0 and E10 fuels at a treat rate of 0.67% w/w is shown in FIGS. 4*b* and 4*c*. It can be seen from the graph that the performance of deposit control additives described herein is significantly superior to that of N-methyl aniline. Specifically, an improvement of about 35% to about 50% is observed for the RON, and an improvement of about 45% to about 75% is observed for the MON.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention.

The invention claimed is:

1. A method for improving the deposit control performance of a fuel, the method comprising combining an additive with the fuel, wherein the additive has the formula:

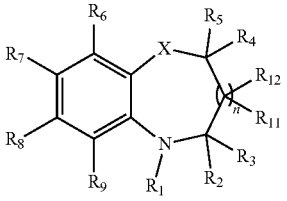

where: $R_1$ is selected from hydrogen, alkyl groups and polymer-containing groups;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1, or is a salt form thereof.

2. A method according to claim 1, wherein $R_2$, $R_3$, $R_4$, $R_5$, $R_{11}$ and $R_{12}$ are each independently selected from hydrogen and alkyl groups.

3. A method according to claim 1, wherein $R_6$, $R_7$, $R_8$ and $R_9$ are each independently selected from hydrogen, alkyl and alkoxy groups.

4. A method according to claim 1, wherein at least one of $R_2$, $R_3$, $R_4$, $R_5$, $R_6$, $R_7$, $R_8$, $R_9$, $R_{11}$ and $R_{12}$ is selected from a group other than hydrogen.

5. A method according to claim 1, wherein no more than five of $R_2$, $R_3$, $R_4$, $R_5$, $R_6$, $R_7$, $R_8$, $R_9$, $R_{11}$ and $R_{12}$ are selected from a group other than hydrogen.

6. A method according to claim 1, wherein at least one of $R_2$ and $R_3$ is hydrogen.

7. A method according to claim 1, wherein at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

8. A method according to claim 7, wherein at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

9. A method according to claim 1, wherein X is —O— or —$NR_{10}$—, where $R_{10}$ is selected from hydrogen, methyl, ethyl, propyl and butyl groups.

10. A method according to claim 1, wherein n is 0.

11. A method according to claim 1, wherein $R_1$ is hydrogen.

12. A method according to claim 11, wherein the additive is selected from:

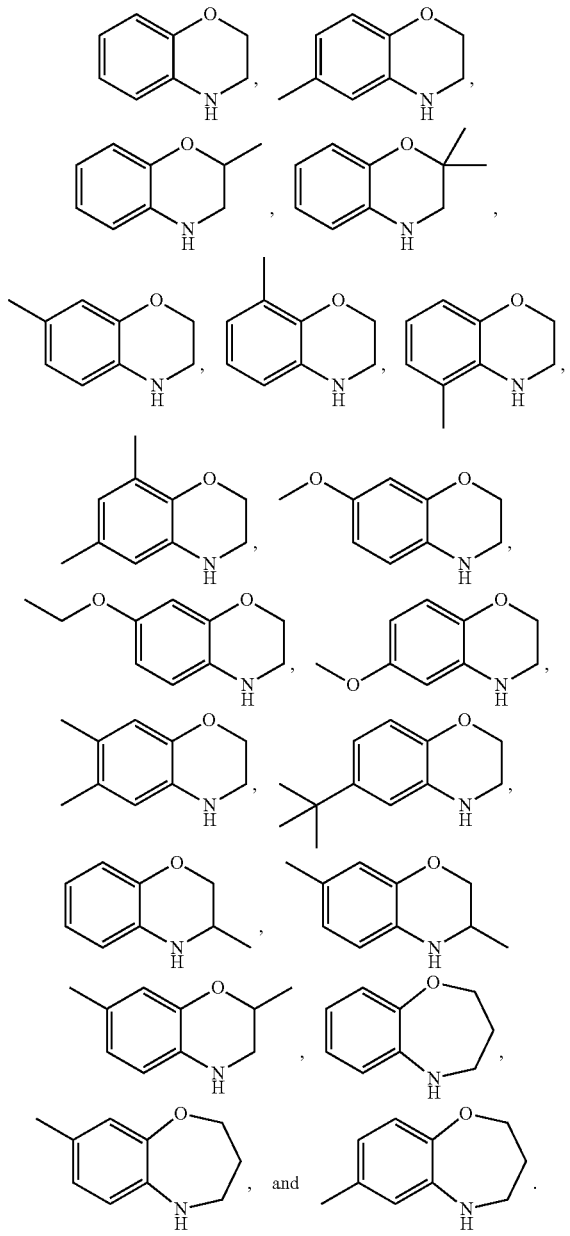

13. A method according to claim 1, wherein the additive is in the form of a salt.

14. A method according to claim 13, wherein the salt comprises a cation having the formula:

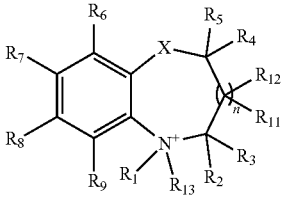

where: $R_1$ is selected from alkyl groups and polymer-containing groups;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups;

n is 0 or 1; and $R_{13}$ is selected from alkyl groups, —$R_{15}$OH and —$R_{15}$COOH, where $R_{15}$ is selected from alkanediyl groups.

15. A method according to claim 14, wherein the salt comprises an anion selected from halides, sulfonates, sulfates, carbonates, bicarbonate, phosphate, borates, nitrates and nitrites.

16. A method according to claim 1, wherein the additive is present in the fuel composition in an amount of up to 20% weight additive/weight base fuel.

17. A method for controlling deposits in a system in which a fuel is used, said method comprising combining an additive with the fuel, wherein the additive has the formula:

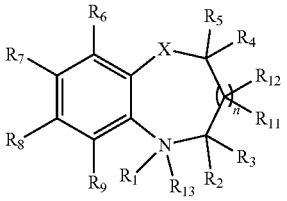

where: $R_1$ is selected from hydrogen, alkyl groups and polymer-containing groups;

$R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1, or is a salt form thereof.

18. A method for at least one of reducing oil degradation, improving drivability, improving fuel economy and improving durability in an engine in which a fuel is used, said method comprising combining an additive with the fuel, wherein the additive has the formula:

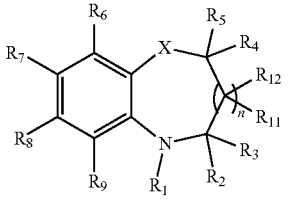

where: $R_1$ is selected from hydrogen, alkyl groups and polymer-containing groups;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1, or is a salt form thereof.

19. A deposit control additive composition for a fuel, the composition comprising:

an additive having the formula:

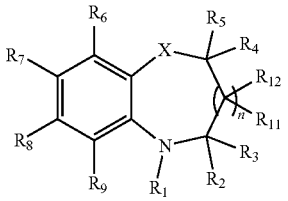

where: $R_1$ is selected from hydrogen, alkyl groups and polymer-containing groups;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1, or is a salt form thereof;

a hydrocarbyl-substituted aromatic compound; and a polyalkylene amine.

20. A deposit control additive for a fuel, the additive being in the form of a salt comprising a cation having the formula:

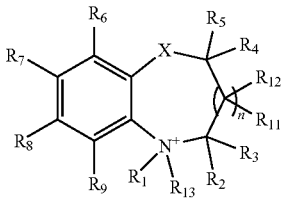

where: $R_1$ is selected from alkyl groups and polymer-containing groups;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups;

n is 0 or 1; and $R_{13}$ is selected from alkyl groups, —$R_{15}$OH and —$R_{15}$COOH, where $R_{15}$ is selected from alkanediyl groups.

* * * * *